US005554483A

United States Patent [19]

DeNoto et al.

[11] Patent Number: 5,554,483

[45] Date of Patent: Sep. 10, 1996

[54] PHOTOGRAPHIC IMAGE INCLUDING AN INK-ACCEPTABLE SURFACE

[75] Inventors: Thomas G. DeNoto, Lexington; Paul E. Nangeroni, Avon; David F. Oberhauser, Stoneham, all of Mass.

[73] Assignee: Polaroid Corporation, Cambridge, Mass.

[21] Appl. No.: 572,177

[22] Filed: Dec. 13, 1995

Related U.S. Application Data

[63] Continuation-in-part of Ser. No. 425,572, Apr. 20, 1995, abandoned.

[51] Int. Cl.[6] ..... G03C 8/32; G03C 11/08

[52] U.S. Cl. ..... 430/237; 430/248; 430/432; 430/941; 430/961

[58] Field of Search ..... 430/237, 248, 430/941, 961, 432

[56] References Cited

U.S. PATENT DOCUMENTS

| | | | |
|---|---|---|---|
| 2,719,791 | 10/1955 | Land | 430/248 |
| 2,794,740 | 6/1957 | Land et al. | 430/248 |
| 2,830,900 | 4/1958 | Land et al. | 430/248 |
| 2,852,372 | 9/1958 | Morse | 430/248 |
| 2,866,705 | 12/1958 | Land et al. | 430/248 |
| 2,874,045 | 2/1959 | Land | 430/248 |
| 3,239,338 | 3/1966 | Rogers | 430/237 |
| 3,287,127 | 11/1966 | Dershowitz | 430/237 |
| 3,770,439 | 11/1973 | Taylor | 430/213 |
| 4,071,366 | 1/1978 | Bourgeois et al. | 430/213 |
| 4,080,346 | 3/1978 | Bedell | 260/17 |
| 4,322,489 | 3/1982 | Land et al. | 430/213 |
| 4,340,522 | 7/1982 | Bronstein-Bonte et al. | 524/766 |
| 4,424,326 | 1/1984 | Land et al. | 526/265 |
| 4,503,138 | 3/1985 | Bronstein-Bonte et al. | 430/213 |
| 4,563,411 | 1/1986 | Bronstein-Bonte | 430/213 |
| 4,794,067 | 12/1988 | Grasshoff et al. | 430/213 |
| 5,395,731 | 3/1995 | Grasshoff et al. | 430/213 |

*Primary Examiner*—Richard L. Schilling
*Attorney, Agent, or Firm*—Jennifer A. Kispert

[57] ABSTRACT

There is disclosed a photographic image including an ink-acceptable surface thereon. The photographic image may be formed by known conventional or diffusion transfer techniques. The ink-acceptable surface is formed by applying an aqueous mixture of a polymeric mordant material over the photograph and forming a relatively clear dry coating thereon. The subject coating provides an ink-acceptable surface upon the photograph which accepts and retains ink applied thereto and resist the remove of such ink therefrom.

15 Claims, No Drawings

PHOTOGRAPHIC IMAGE INCLUDING AN INK-ACCEPTABLE SURFACE

CROSS-REFERENCE TO RELATED APPLICATIONS

This application is a continuation-in-part of prior application Ser. No. 08/425,572, filed Apr. 20, 1995, now abandoned.

BACKGROUND OF THE INVENTION

Methods for forming photographic images by both diffusion transfer and conventional techniques are well known, as are the film units used in such methods. Diffusion transfer film units, often referred to as "instant" film, include both "peel apart" and "integral" formats. Peel apart film units are characterized by including an image-receiving element which is separated from a photosensitive element after exposure and processing; whereas integral film units include an image-receiving element and photosensitive element which are maintained as a superimposed integral unit after exposure and processing. Various embodiments of both peel apart and integral formats are known in the art, including those wherein images are formed in black and white, and color, as described in: E. H. Land, H. G. Rogers, and V. K. Walworth, in J. M. Sturge, ed., Neblette's Handbook of Photography and Reprography, 7th ed., Van Nostrand Reinhold, New York, 1977, pp. 258–330; and V. K. Walworth and S. H. Mervis, in J. Sturge, V. Walworth, and A. Shepp, eds., Imaging Processes and Materials: Neblette's Eighth Edition, Van Nostrand Reinhold, New York, 1989, pp. 181–225.

In general, diffusion transfer photographic products and processes involve film units having a photosensitive element including at least one silver halide layer. After photoexposure, the photosensitive element is developed, generally by uniformly distributing an aqueous alkaline processing composition over the photoexposed element, to establish an imagewise distribution of a diffusible image-providing material. The image-providing material, (typically image dyes or complexed silver), is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing. In diffusion transfer photographic products of the peel-apart format, the image is viewed in the image-receiving layer upon separation of the image-receiving element from the photosensitive element alter a suitable imbibition period. With integral formats, such separation is not required.

Black and white diffusion transfer images are generally formed by exposing and developing a silver halide emulsion, and subsequently dissolving and transferring silver from unexposed, or less exposed regions, to an image-receiving layer containing silver precipitating agents or nuclei. Examples of such film units are provided in U.S. Pat. Nos. 2,543,181; 2,698,236; 2,698,238; 2,698,245; 2,789,054; 3,234,022; 4,163,816; 4,204,869; and 4,489,152. Commercial embodiments of such film units include Polapan® Pro 100, available from the Polaroid Corporation.

Color images are generally formed by the imagewise transfer of image dyes from a photosensitive element to an image-receiving layer containing a dye mordant material. Examples of such film units are provided in U.S. Pat. Nos. (Ser. No. 08/243,974), 3,856,521; 3,856,522; and 3,836,365. Commercial embodiments of such film units include Polacolor® 2, Polacolor® 100, Polacolor® Pro 100, SX-70®, Time Zero®, 600 Plus™, Spectra®, and Captiva 95®, all available from the Polaroid Corporation.

In early versions of black and white peel-apart diffusion transfer film units, image stability was commonly enhanced by swabbing a coating mixture directly upon the image-receiving element after processing and separation from the photosensitive element. Such coating mixtures typically included aqueous solutions comprising materials such as vinyl acetate, acrylic polymers, waxes, resins, polyvinyl acid, sodium carboxymethyl cellulose, ethyl cellulose, nylon, gelatin, vinyl pyrrolidone, sugars, polybasic alcohols, etc. Other solutions utilized included salts of heavy metal cations e.g. zinc, cadmium, lead, etc.; and aqueous solutions of boron compounds and polyvinyl alcohol. Detailed descriptions of such coating mixtures are provided in U.S. Pat. Nos.: 2,719,791; 2,794,740; 2,830,900; 2,852,372; 2,866,705; 2,874,045; 3,239,338; and 3,287,127.

Conventional film units, e.g. 35 mm film (including both black & white and color), are well known in the art along with the methods for forming and developing images therewith. A detailed description of such film units and processes is provided in: J. M. Sturge, ed., Neblette's Handbook of Photography and Reprography, 7th ed., Van Nostrand Reinhold, New York, 1977; J. Sturge, V. Walworth, and A. Shepp, eds., Imaging Processes and Materials: Neblette's Eighth Edition, Van Nostrand Reinhold, New York, 1989; and T. H. James ed., The Theory of the Photographic Process, Fourth Edition, Macmillan Publishing Co., Inc. New York, 1977.

The image-bearing surfaces of most modern photographic film units (both diffusion transfer and conventional types) are not "ink-acceptable." That is, the surface of the photograph will not typically accept and retain inks applied thereto, particularly water-based inks such as those used in ball point pens, felt-tip pens, highlighters, and those used by governmental agencies to stamp personal identification photographs. When such inks are applied to most photographs, the inks are easily rubbed-off or smudged unless permitted to dry for extended periods of time.

It is desired to create a photographic image including an ink-acceptable surface which will accept inks applied thereto, e.g. by way of stamp, typed, hand written, etc., and prevent such inks from being easily removed therefrom after only short periods of drying (i.e., a few minutes).

SUMMARY OF THE INVENTION

The present invention includes a photographic image having an ink-acceptable surface thereon, along with a method for making the same. The subject ink-acceptable surface may be used in conjunction with photographic images formed by both conventional and diffusion transfer processes. The subject method comprises the step of applying an aqueous mixture to the surface of a photograph wherein the aqueous mixture comprises a polymeric mordant material including monomer units represented by Formula 1.

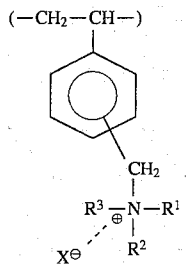

Formula 1 wherein $R^1$, $R^2$, $R^3$, and X are described below.

The present invention finds utility in applications where photographs are required to retain ink thereon. Examples of such applications include photographs utilized for identification purposes by governmental agencies which should retain information stamped or written in ink thereon and be resistant to such information being smudged or rubbed off easily.

DETAILED DESCRIPTION OF THE PREFERRED EMBODIMENTS

As indicated above, the present invention relates to a photograph having an ink-acceptable surface thereon and a method for making the same. The term "ink-acceptable" is intended to mean capable of receiving and retaining inks and preventing them from being easily rubbed-off or smudged within minutes after their application. The term "ink" is intended to include inks including dyes and/or pigments, and dyes which are solvent-based and water-based inks, although water-based inks are more commonly used in most applications and are typically more difficult to prevent from being rubbed-off or smudged upon the surface of the photograph.

The subject ink-acceptable surface may be applied to photographs formed by conventional (e.g. 35 mm) and diffusion transfer (i.e. "instant" including both peel-apart and integral formats) processes. The ink-acceptable surface is created by applying an aqueous mixture of a polymeric mordant material to the surface of the photograph. The aqueous mixture may be applied to the surface of a photograph in a variety of ways including swabbing, Meyer rod coating, spraying, flowing, etc. The preferred commercial application method includes swabbing the surface of the photograph with an absorbent material which has been saturated or partially saturated with the subject aqueous mixture. This general technique is known in the art and is described in U.S. Pat. Nos.: 2,719,791; 2,794,740; 2,830,900; 2,852,372; 2,866,705; 2,874,045; 3,239,338; and 3,287,127. An example of an absorbent material for applying the subject aqueous mixture includes a non-woven cotton material, preferably with a soap finish such as that available from the Veratec Company, as Grade R2951. Typically, the absorbent material is partially enclosed within a plastic applicator in order to prevent the aqueous mixture from contacting one's skin during the application of the mixture to the photograph.

Different types of integral diffusion transfer photographic film units are known. In one type, exposure of the photosensitive element and viewing of the image formed are carried out through the same surface of the film unit. In another type, exposure of the photosensitive element and viewing of the image formed are carried out through different surfaces of the film unit. A detailed description of the various integral diffusion transfer photographic film units is provided in J. Sturge, V. Walworth and A. Shepp, eds. [Imaging Processes and Materials: Neblettes Eighth Edition], Van Nostrand Reinhold, New York, 1989. It will be apparent that the ink-acceptable surface is applied to the surface of the integral diffusion transfer film unit through which the image is viewed. With diffusion transfer film units where the photosensitive and image-receiving elements are separated after the image is formed, the ink-accepting surface is applied to the surface of the image-receiving element.

The aqueous mixture of the present invention comprises a polymeric mordant material including quaternary ammonium monomer units, the same or different, represented by Formula 1.

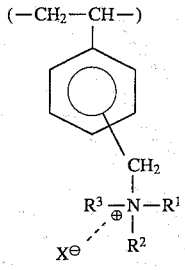

Formula 1 wherein each of $R^1$, $R^2$, and $R^3$ is independently alkyl (e.g., methyl, ethyl, propyl, butyl); substituted-alkyl (e.g., hydroxyethyl, hydroxypropyl); cycloalkyl (e.g., cyclohexyl); aryl (e.g., phenyl, naphthyl); aralkyl (e.g., benzyl); alkaryl (e.g., tolyl); or at least two of $R^1$, $R^2$ and $R^3$ together with the quaternary nitrogen atom to which they are bonded complete a saturated or unsaturated, substituted or unsubstituted nitrogen-containing heterocyclic ring (e.g., morpholino, piperidino or 1-pyridyl); and X is a counteranion (e.g., halide). Preferred $R^1$, $R^2$ and $R^3$ groups include alkyl, such as alkyl groups of from 1 to about 8 carbon atoms wherein each of $R^1$, $R^2$ and $R^3$ is the same alkyl group, such as methyl; cyclohexyl; and benzyl. Other preferred compounds are those, for example, wherein $R^1$ and $R^2$ are each alkyl, e.g., methyl, and $R^3$ is cyclohexyl. The groups $R^1$, $R^2$ and $R^3$ of the monomer units represented by Formula I can complete with the quaternary nitrogen atom a nitrogen-containing heterocyclic ting. The nitrogen-containing heterocyclic ring can comprise a saturated or unsaturated ring and, additionally, can be a substituted or unsubstituted heterocyclic ting. It will be appreciated that the formation of a saturated N-containing heterocyclic ring will involve two of the $R^1$, $R^2$ and $R^3$ groups while in the formation of an unsaturated nitrogen-containing heterocyclic ring such as 1-pyridyl, each of groups $R^1$, $R^2$ and $R^3$ will be involved. Other examples of suitable nitrogen-containing heterocyclic groups formed with the quaternary nitrogen atom include morpholino and piperidino.

The moiety X shown in Formula 1 is an anion such as halide (e.g., bromide or chloride). Other anionic moieties representative of anion X include sulfate, alkyl sulfate, alkanesulfonate, arylsulfonate (e.g., p-toluenesulfonate), acetate, phosphate, dialkyl phosphate or the like. A preferred anion is chloride.

Preferred monomer units within Formula 1 are:

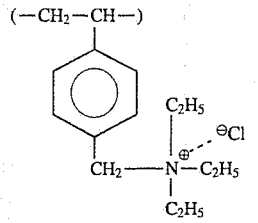

Formula 2(a)

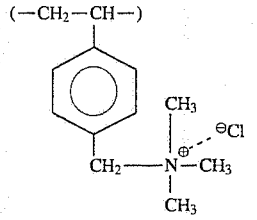

Formula 2(b)

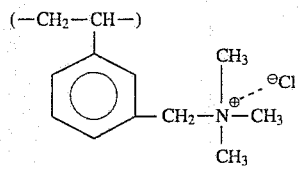

Formula 2(c)

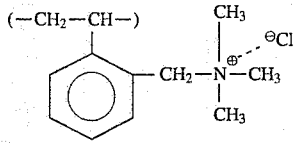

Formula 2(d)

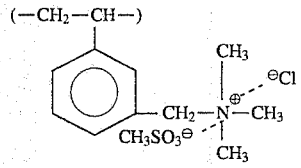

Formula 2(e)

As noted previously, such monomer units may be incorporated in the mordant material individually or combinations thereof may be used.

Such polymeric mordant materials are well known in the color diffusion transfer art and specific examples and their corresponding synthesis are provided in U.S. Pat. Nos. 5,395,731; 4,794,067; 4,563,411; 4,503,138; 4,424,326; 4,340,522; 4,322,489; 4,080,346; 4,071,366; and 3,770,439, all assigned to the Polaroid Corporation and incorporated herein by reference. These mordant materials include copolymers of 4-vinyl pyridine (4VP) and vinylbenzylalkylammonium monomer units, copolymers of 4VP and vinylbenzylalkylammonium monomer units grafted onto hydroxyethylcellulose and copolymers of 4VP and vinylbenzylalkylammonium monomer units grafted onto polyvinyl alcohol. Such graft copolymers and their use as image-receiving layers are further described in U.S. Pat. Nos. 3,756,814 and 4,080,346 issued to Stanley F. Bedell and U.S. Pat. No. 5,422,233 to Eckert et al., all of which are incorporated herein by reference.

Preferred polymeric mordant materials for use according to the invention are represented by Formula 3.

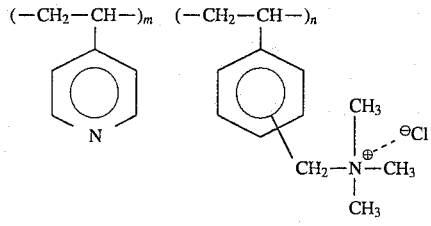

Formula 3 wherein $R^1$, $R^2$, $R^3$ and X are as previously defined and m and n represent the relative molar ratios of monomer units and are typically from 3:1 to 1:6.

Particularly preferred polymeric mordant materials within Formula 3 include: a 1:6 molar ratio of 4VP (m=1) and vinylbenzyltrimethylammonium chloride (TMQ - $R^1$, $R^2$ and $R^3$ are $-CH_3$, X is $Cl^-$ and n is 6) and a 4.9/1/1.9 molar ratio of 4VP (m=4.9) and TMQ (n=1) grafted onto hydroxyethylcellulose (1.9).

Another preferred polymeric mordant material according to the invention is a 7.0/3.5/1.0 molar ratio copolymer of TMQ, vinylbenzyltriethylammonium chloride, TEQ–$R^1$, $R^2$ and $R^3$ are $-C_2H_5$ and X is $Cl^-$) and vinylbenzyldimethyldodecylammonium chloride (DMQ- $R^1$ and $R^2$ are $-CH_3$, $R^3$ is $C_{12}H_{25}$ and X is $Cl^-$).

The mordant materials encompassed by Formula 3 may be prepared utilizing known synthesis techniques. By way of example, such materials may be made by adding 240 ml of distilled water to a total of 60 grams of monomer, wherein the monomer comprises between a 3:1 to 1:6 molar ratio of 4VP to TMQ. This mixture is degassed with nitrogen for 30 minutes and heated to 65° C. At this temperature, the reaction is initiated by the addition of approximately 0.4 grams of azocyanovaleric acid and allowed to stir at 65° C. overnight.

The aqueous mordant mixture preferably comprises from about 3%–8% by weight mordant material. Furthermore, the aqueous mixture preferably includes a wetting agent. Although many different wetting agents may be used, those including at least one alcohol group are preferred. Particularly preferred wetting agents include methanol, ethanol, propanol, and isopropanol. Wetting agents preferably make up between about 10%–20% by weight of the subject aqueous mixture. The alcohol-type wetting agents noted above are preferred as they evaporate relatively quickly and providing a dry polymeric coating. The aqueous mixture may further include other addenda. For example, various surfactants and deodorants may be used. Small amounts of an acid, for example, about 1% by weight of acetic acid, can be added to the aqueous coating mixture to provide improved spreadability.

The aqueous mixture described above produces a substantially clear, ink-acceptable, glossy coating. If a less glossy finish is desired, a material for providing a reduced gloss surface may be included within the aqueous mixture. Suitable materials which can be used to reduce the gloss of the mordant layer include insoluble inorganic particulate materials such as silica and clay, cellulosic materials such as starch and carboxymethylcellulose and polymeric mixtures such as cellulose acetate dissolved in ethyl acetate and methanol. These materials may be used alone or in combination. Experiments have shown that one starch, i.e. RediSize® 101 from National Starch provided an acceptable matte surface whereas another starch, RediSize 100, did so when blended with carboxymethylcellulose. Typically, the aqueous coating mixture will include from about 1% to about 10% by weight of such additive(s), depending upon the particular material(s) used and the type of finish desired. Routine scoping tests may be conducted to determine the amount(s) needed to obtain the desired result in any particular instance.

Although the subject method is applicable to photographs formed by both conventional and diffusion transfer photographic methods, for purposes of further illustration, the subject method will be described in connection with a preferred commercially available black & white, peel-apart diffusion transfer film unit commercial available under the name Polapan® Pro 100 from the Polaroid Corporation.

EXAMPLES

Ten Polapan® Pro 100 film units were exposed to an imagewise pattern and photographically processed, followed by separation of the photosensitive element from the image-receiving element. Eight of the image-receiving elements (1–8) were then coated with an aqueous mixture containing a polymeric mordant material according to the invention, and two image-receiving elements (9 and 10) were coated with different material for comparison purposes. The coatings were air dried and an ink image was subsequently applied (by way of a stamp pad) to the surface of the image-receiving element and allowed to dry for approximately 1–2 minutes. The film units were then tested by wiping the inked surface with a dry paper tissue. The results of this testing are provided below in Table 1.

The polymeric mordant material utilized in the aqueous mixtures of examples 1–6 consisted of a copolymer of 4-vinylpyridine (4VP) and vinylbenzyltrimethyl ammonium chloride (TMQ) in a 1:6 molar ratio (1 4VP to 6 TMQ), as previously described with respect to Formula 3.

The aqueous mixture utilized in example 1 was prepared by adding 5 ml of isopropanol to 5 ml of a 30% by weight aqueous solution of the mordant material. To this mixture, 20 ml of deionized water was added and the resulting mixture (approximately 5% by volume) was mixed and coated upon a processed Polapan Pro® 100 image-receiving element using a number 3 Meyer rod providing a coverage of mordant material approximately 430 mg/m$^2$.

The aqueous mixture utilized in example 2 was prepared by adding 1 ml of a 30% by weight aqueous dispersion of 14 nm silica, (Nyacol™ 1430LS available from the Nyacol Division of the Akzo Nobel Company) to 10 ml of an approximately 5% by volume solution in alcohol/water of the mordant material. To this mixture, 0.5 ml of isopropanol was added and the resulting mixture was mixed and coated as described in Example 1, utilizing a number 3 Meyer rod providing a coverage of approximately 430 mg/m$^2$ of mordant material and approximately 258 mg/m$^2$ of silica.

The aqueous mixtures utilized in examples 3 and 4 were prepared in a substantially similar manner as described with respect to Example 2 but utilizing the Meyer rods and coverages of mordant and silica material as indicated in Table 1.

The aqueous mixtures utilized in examples 5 and 6 were prepared by adding 0.5 gram of clay (Burgess Icecap K available from the Burgess Pigment Company) to 10 ml of the approximately 5% by volume solution in alcohol/water of the mordant material as described in examples 1–4. These mixtures were sonified and coated utilizing the Meyer rods and coverages of the mordant and clay materials as indicated in Table 1.

The polymeric mordant material utilized in the aqueous mixture of example 7 consisted of a 4.9/1/1.9 (molar ratio) copolymer of 4VP and TMQ grafted onto hydroxyethylcellulose (HEC). An aqueous mixture was prepared with 500 ml of a 4% solution of the mordant, 200 ml of a 25% solution of starch, RediSize® 100 from National Starch, 60 ml of a 9.5% solution of carboxymethylcellulose and 114 ml of distilled water. The resulting mixture was mixed and coated as described above using a Meyer No. 12 rod to provide the coverage of the mordant, starch and HEC indicated in Table 1.

The polymeric mordant utilized in the aqueous mixture of example 8 consisted of a 7.0/3.5/1.0 (molar ratio) copolymer of TMQ, TEQ and DMQ. The aqueous mixture was prepared with 16 ml of a 12.8% solution of the mordant, 20 ml of a 25% solution of starch (RediSize 100), 44 ml of distilled water and 4 ml of isopropanol. The resulting mixture was mixed and coated as described above using a Meyer No. 12 rod to provide the coverages of mordant and starch recited in Table 1.

The aqueous mixtures utilized in examples 9 and 10 served as comparisons for examples 1–8. The mixture utilized in example 9 consisted of 10 ml of a 2% by weight solution of a modified polyvinylalcohol material including silanol functional groups, (Kuraray R2130 available from the Kuraray Company LTD) coated with a number 3 Meyer rod providing a coverage of approximately 172 mg/m$^2$. The mixture used in example 10 was prepared as the mixture of example 9; however, 1 ml of a 30% by weight aqueous dispersion of 14 nm silica (as used in examples 2–4) was added and mixed therewith and subsequently coated with a number 3 Meyer rod providing an approximate coverage of 172 mg/m$^2$ of polyvinylalcohol material and 237 mg/m$^2$ of silica.

TABLE 1

| Example No. | Meyer Rod No. | Coverage (mg/m$^2$) | Evaluation |
|---|---|---|---|
| 1 | 3 | 430 (mordant) | Good ink acceptability; glossy surface. |
| 2 | 3 | 430 (mordant)<br>258 (silica) | Fair-Good ink acceptability; glossy surface. |
| 3 | 9 | 969 (mordant)<br>581 (silica) | Good ink acceptability; slightly glossy surface. |
| 4 | 18 | 1669 (mordant)<br>1001 (silica) | Good ink acceptability; slightly glossy surface. |
| 5 | 3 | 430 (mordant)<br>430 (clay) | Good ink acceptability; slightly matte surface |
| 6 | 18 | 1669 (mordant)<br>1669 (clay) | Excellent ink acceptability; slightly matte surface |
| 7 | 12 | 248 (mordant)<br>613 (starch)<br>161 (CMC) | Good ink acceptance; acceptable matte surface |
| 8 | 12 | 592 (mordant)<br>1442 (starch) | Fair ink acceptance; good matte finish |
| 9 | 3 | 172 (modified PVA) | Fair ink acceptability; some smearing; glossy surface. |
| 10 | 12 | 172 (modified PVA)<br>237 (silica) | Poor ink acceptability; smearing; poor coating quality |

As is shown by the evaluations provided in Table 1, examples 1–8 which included the subject ink-acceptable surface had superior ink acceptability when compared with those of examples 9 and 10 which included the modified polyvinylalcohol material. More specifically, the ink applied to the surfaces of examples 9 and 10 was smeared when rubbed with a tissue, whereas the ink applied to the surfaces of examples 1–8 was not smeared or removed when subject to the same testing conditions. Furthermore, as indicated in Table 1, the subject ink-acceptable surface may be designed with various degrees of gloss by including clay, silica or starch. The best matte finish was obtained in example 7 which had a combination of starch and carboxymethylcellulose.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

What is claimed is:

1. A method for providing an ink-acceptable surface upon a photographic image, said method comprising the step of applying to the surface of a photographic image an aqueous mixture comprising a polymeric mordant material including monomer units represented by the formula

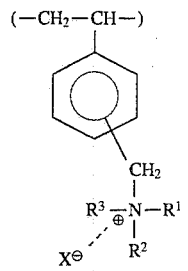

wherein each of $R^1$, $R^2$ and $R^3$ is independently alkyl, substituted alkyl, cycloalkyl, aryl, aralkyl or at least two of $R^1$, $R^2$ and $R^3$, together with the nitrogen atom to which they are bonded complete a saturated or unsaturated nitrogen-containing heterocyclic ring and X is an anion.

2. The method as defined in claim 1 wherein said mordant material includes monomer units represented by the formula:

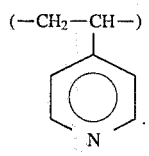

3. The method as defined in claim 1 wherein $R^1$, $R^2$ and $R^3$ are each independently alkyl.

4. The method as defined in claim 1 wherein said aqueous mixture includes a wetting agent.

5. The method as defined in claim 1 wherein said aqueous mixture includes a material for providing a surface having reduced gloss.

6. The method as defined in claim 5 wherein said material for providing a surface having reduced gloss is a member of the group consisting of silica, clay, cellulosic materials and mixtures thereof.

7. The method as defined in claim 1 wherein said step of applying said aqueous mixture comprise swabbing the surface of said photographic image with an absorbent material containing said aqueous mixture.

8. A method for providing an ink-acceptable surface on a diffusion transfer photographic image comprising the steps of forming a photographic image by exposing to an image-wise pattern of radiation a diffusion transfer photographic film unit which includes a photosensitive element arranged in superposed or superposable relation with an image-receiving element, said photosensitive element comprising a support carrying at least one silver halide emulsion layer, and developing said exposed photosensitive element with an aqueous alkaline processing composition whereby there is formed an image in said image-receiving element; and applying to the surface of said photographic image an aqueous mixture comprising a polymeric mordant material including monomer units represented by the formula

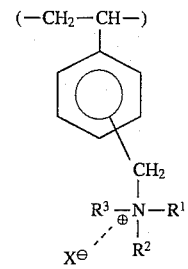

wherein each of $R^1$, $R^2$ and $R^3$ is independently alkyl, substituted alkyl, cycloalkyl, aryl, aralkyl or at least two of $R^1$, $R^2$ and $R^3$, together with the nitrogen atom to which they are bonded complete a saturated or unsaturated nitrogen-containing heterocyclic ring and X is an anion.

9. The method as defined in claim 8 wherein said mordant material includes monomer units represented by the formula

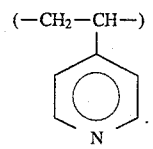

10. The method as defined in claim 8 wherein said photosensitive element and said image-receiving element are retained together after said image is formed.

11. The method as defined in claim 8 wherein said photosensitive element and said image-receiving element are separated from each other after said image is formed.

12. The method as defined in claim 8 wherein $R^1$, $R^2$ and $R^3$ each independently is alkyl.

13. The method as defined in claim 8 wherein said aqueous mixture includes a wetting agent.

14. The method as defined in claim 8 wherein said aqueous mixture includes a material for providing a surface having reduced gloss.

15. The method as defined in claim 14 wherein said material for providing a surface having reduced gloss is a member of the group consisting of silica, clay, cellulosic materials and mixtures thereof.

* * * * *